US011067362B1

(12) United States Patent
Chin

(10) Patent No.: US 11,067,362 B1
(45) Date of Patent: Jul. 20, 2021

(54) SIGHT WITH LIGHT REFLECTION INDICATOR FOR FIREARMS

(71) Applicant: Strike Industries, Inc., Santa Ana, CA (US)

(72) Inventor: David Hyung Chin, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/918,091

(22) Filed: Jul. 1, 2020

(51) Int. Cl.
*F41G 1/30* (2006.01)
*F41G 1/10* (2006.01)
*F41C 3/00* (2006.01)

(52) U.S. Cl.
CPC ..... *F41G 1/30* (2013.01); *F41C 3/00* (2013.01); *F41G 1/10* (2013.01)

(58) Field of Classification Search
CPC ..... F41G 1/01; F41G 1/02; F41G 1/06; F41G 1/10; F41G 1/12; F41G 1/30
See application file for complete search history.

(56) References Cited

U.S. PATENT DOCUMENTS 1,363,553 A * 12/1920 Barringer ..... F41G 1/12 42/145
4,505,047 A * 3/1985 Elbe ..... F41G 1/02 42/143
9,562,743 B1 * 2/2017 Mansfield ..... F41G 1/345
2019/0277599 A1 * 9/2019 Meares, IV ..... F41G 1/54

* cited by examiner

*Primary Examiner* — J. Woodrow Eldred

(74) *Attorney, Agent, or Firm* — Andy M. Han; Han IP PLLC

(57) ABSTRACT

A device implementable on a firearm includes a one-piece sight functioning as a rear sight or a front sight when installed on the firearm. The one-piece sight includes a notch and a user-facing side configured with a first surface aligned with the notch and a second surface on two opposite sides of the first surface. The first and second surfaces are sloped at first and second angles, respectively, to reflect an ambient light at different angles.

20 Claims, 6 Drawing Sheets

α = Ramp Angle

α = Ramp Angle

SIGHT WITH LIGHT REFLECTION INDICATOR FOR FIREARMS

TECHNICAL FIELD

The present disclosure is generally related to firearm accessories and, more particularly, to a sight with light reflection indicator for firearms.

BACKGROUND

Unless otherwise indicated herein, approaches described in this section are not prior art to the claims listed below and are not admitted as prior art by inclusion in this section.

On certain firearms, including rifles, carbines, shotguns and pistols, sights are useful tools that aid a user of the firearm in aiming and target acquisition. Typical sights used on a firearm include iron sights, polymer sights and suppressor-height sights. In some cases, sights are marked with bright color paint, engraving or glow-in-the-dark paint, or a separate insert such as fiber optic or tritium is added to the front sight and/or rear sight, so as to enhance accuracy and reduce the time used in aiming. However, such marking or added insert tends to require additional assembly or manufacturing time, thereby increasing the manufacturing cost.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose innovative designs of a sight with light reflection indicator. It is believed that the proposed designs can avoid or otherwise minimize aforementioned issues associated with conventional firearm sights. That is, the one-piece construction of the proposed designs would not require any additional marking or assembly step. Moreover, the proposed designs render centering more intuitive by using a vertical line or strip as opposed to traditional dot-to-dot alignment.

In one aspect, a device implementable on a firearm (e.g., a semi-automatic pistol, a revolver, a rifle, a carbine or a shotgun) may include a one-piece sight functioning as a rear sight or a front sight when installed on the firearm. The one-piece sight may include a base and a structure. The base may have a first primary side and a second primary side opposite the first primary side. The structure may extend from a ground plane on the first primary side of the base with a notch at a center of a distal end of the structure that is away from the base. The structure may have a user-facing side configured with a first surface aligned with the notch and a second surface on two opposite sides of the first surface. The first and second surfaces may be sloped at first and second angles, respectively, with respect to the ground plane to reflect an ambient light at different angles.

In another aspect, a device implementable on a firearm (e.g., a semi-automatic pistol, a revolver, a rifle, a carbine or a shotgun) may include a one-piece sight functioning as a rear sight or a front sight when installed on the firearm. The one-piece sight may include a notch and a user-facing side configured with a first surface aligned with the notch and a second surface on two opposite sides of the first surface. The first and second surfaces may be sloped at first and second angles, respectively, to reflect an ambient light at different angles.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
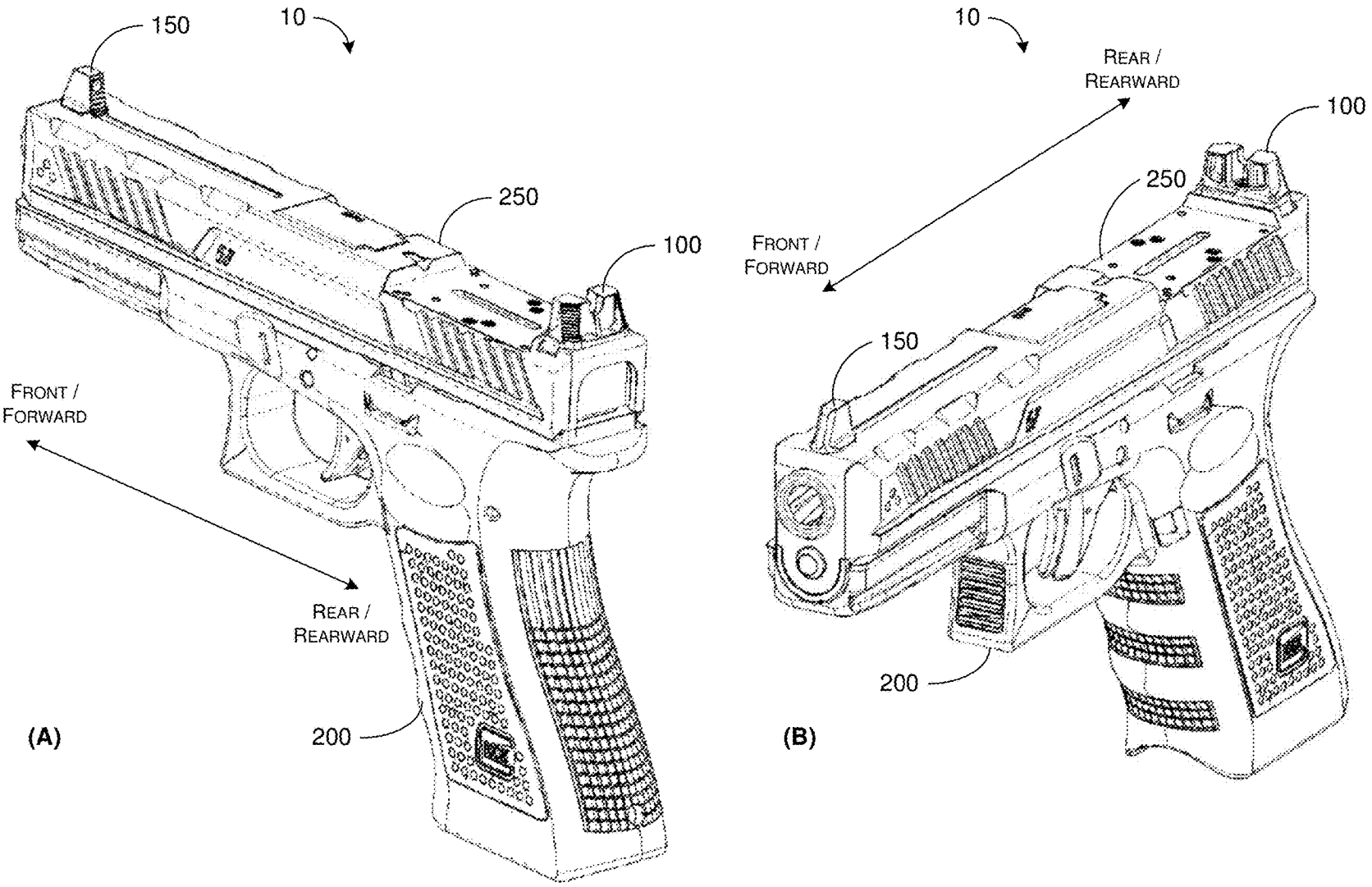
FIG. 1 is a diagram of an apparatus in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

FIG. 1 illustrates an apparatus 10 in accordance with an implementation of the present disclosure. Part (A) of FIG. 1 shows a rear perspective view of apparatus 10 and part (B) of FIG. 1 shows a front perspective view of apparatus 10. Referring to FIG. 1, apparatus 10 may include a device 100 and one other device 150 installed on a firearm 200 (which is shown as a semi-automatic pistol in FIG. 1 but could be another type of firearm such as a revolver, rifle, carbine or shotgun). In the example shown in FIG. 1, firearm 200 may include a slide assembly 250 on which device 100 and device 150 are installed. It is noteworthy that while, in the example shown in FIG. 1, device 100 functions as a rear sight while device 150 functions as a front sight with respect to firearm 200, device 100 may be installed elsewhere and function as a front sight on firearm 200 or another firearm. Under various proposed designs in accordance with the present disclosure, device 100 may include a one-piece sight configured with physical features to reflect an ambient light at different angles, thereby enhance the ease and speed of target acquisition. Detailed description of device 100 is provided below with respect to FIG. 2~FIG. 6.

Figure 2:
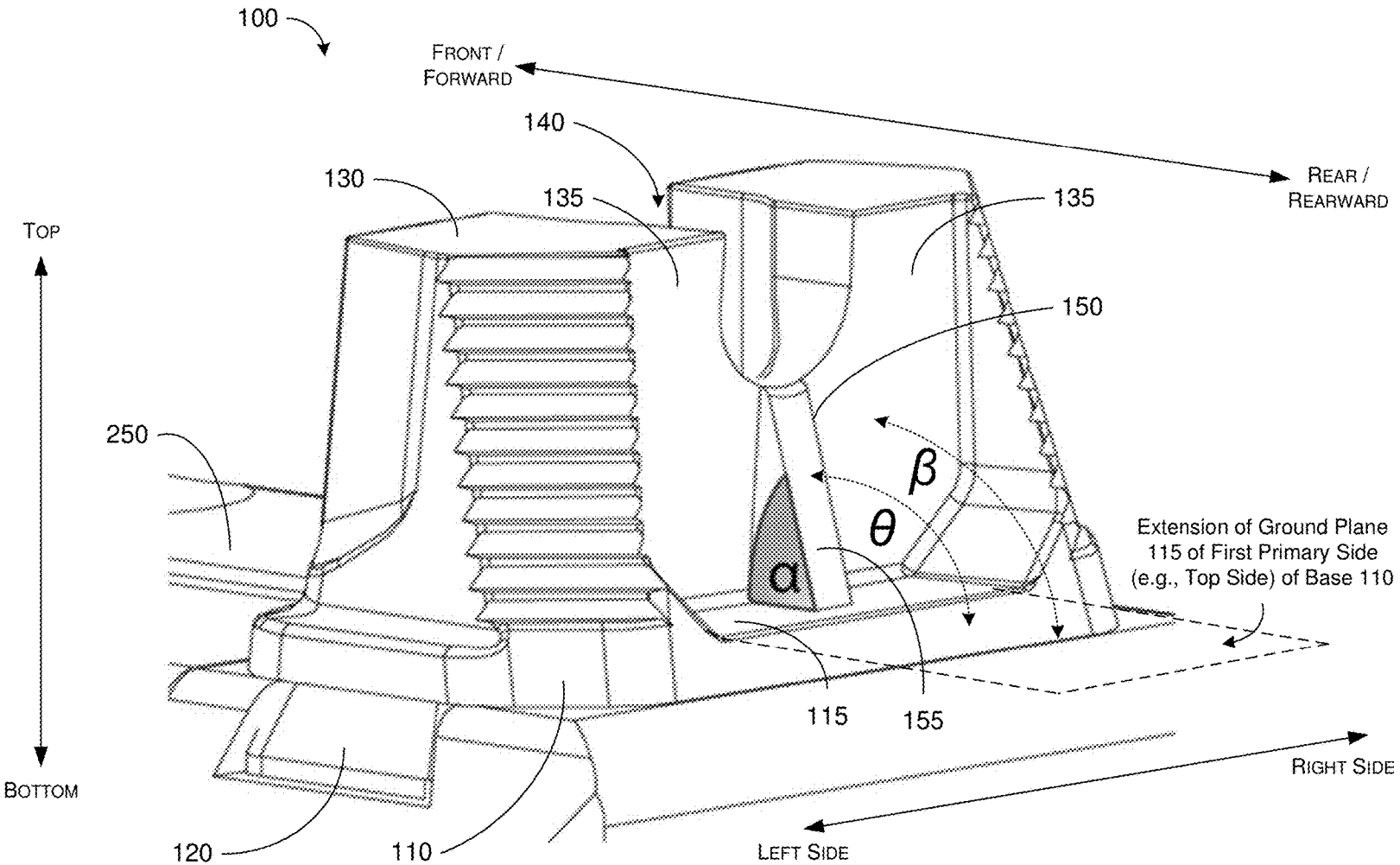
FIG. 2 is a diagram of a perspective view of a device in accordance with an implementation of the present disclosure.
Figure 3:
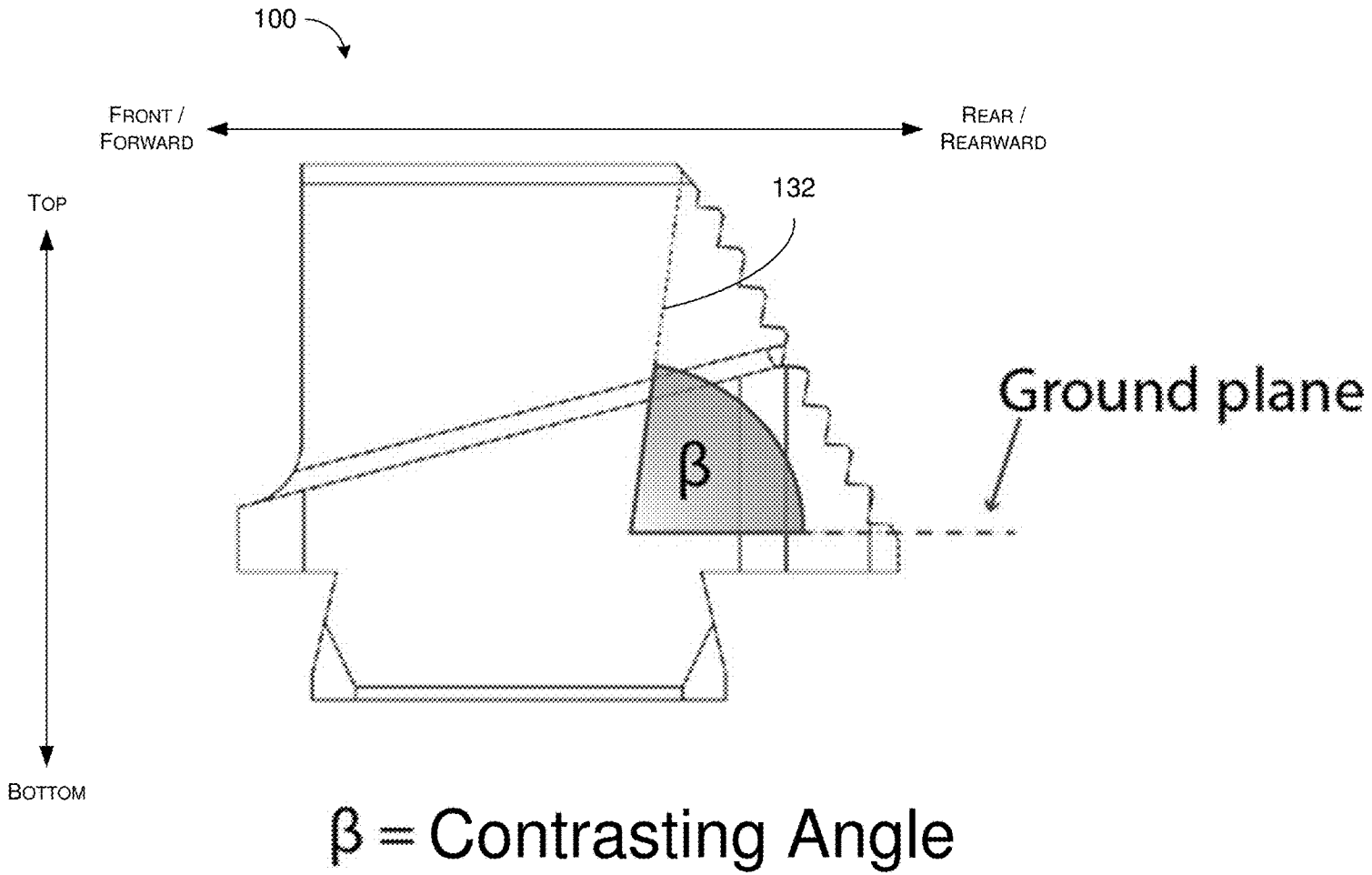
FIG. 3 is a diagram of a cross-sectional view of a device in accordance with an implementation of the present disclosure.
Figure 4:
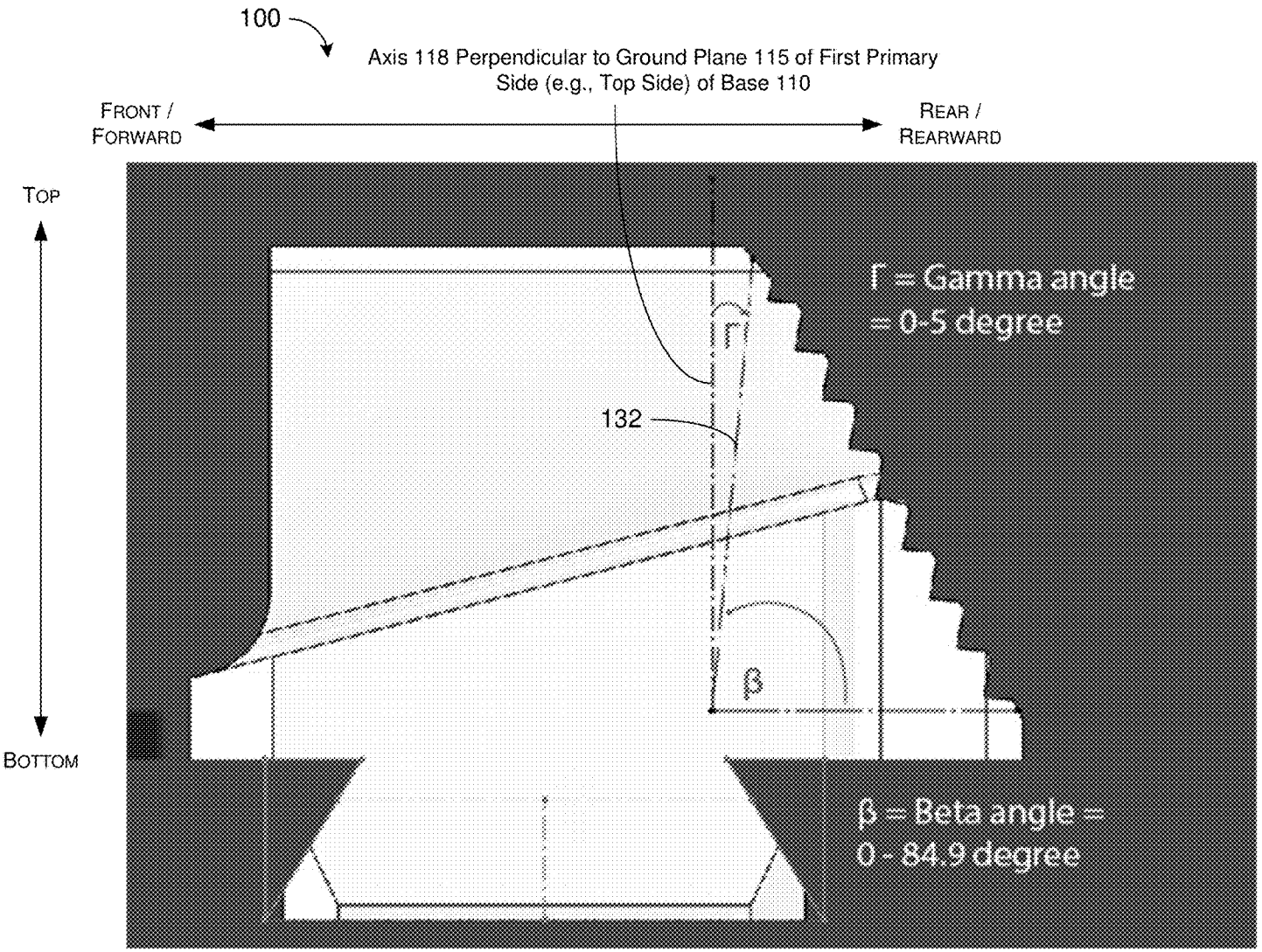
FIG. 4 is a diagram of another cross-sectional view of a device in accordance with an implementation of the present disclosure.

Each of FIG. 2~FIG. 4 illustrates a perspective view or a cross-sectional view of device 100. Referring to FIG. 2~FIG. 4, the one-piece sight of device 100 may include a base 110, a mounting portion 120 and a structure 130. The one-piece sight of device 100 may be a monolithic piece made of metal, polymer or another material with suitable mechanical properties to function as a sight on a firearm. Base 110 may have a first primary side (e.g., top side with respect to firearm 200 when installed thereon) and a second primary side (e.g., bottom side with respect to firearm 200 when installed thereon) opposite the first primary side. Structure 130 may extend from a ground plane 115 on the first primary side of base 110 with a notch 140 at a center of a distal end of structure 130 (e.g., top end of structure 130 with respect to firearm 200 when installed thereon) that is away from base 110. Mounting portion 120 may extend from the second primary side of base 110, and mounting portion 120 may be configured to mate with a dovetail rail or a groove on firearm 200 to result in mounting portion 120 being received in the dovetail rail or the groove when the one-piece sight is installed on firearm 200 (e.g., on slide assembly 250 in the example shown in FIG. 1).

Under a proposed design in accordance with the present disclosure, structure 130 may have a user-facing side (e.g., rear-facing side with respect to firearm 200 when installed thereon). The user-facing side may be configured with a first surface 155 that is disposed below and aligned with notch 140, thereby rendering centering more intuitive. The user-facing side may also be configured with a second surface 135 that is on two opposite sides (e.g., left side and right side) of the first surface 135 when viewed from the rear of device 100 and firearm 200 (e.g., from the perspective of a user of the firearm when the user is holding up firearm 200 in a shooting posture). The first surface 155 may be shaped like a vertical line or strip to function as a sight indicator, together with notch 140. The first surface 155 and the second surface 135 may be sloped at a first angle ($\theta$) and a second angle ($\beta$), respectively, with respect to ground plane 115 (e.g., when viewed from the perspective of the user when the user is holding up firearm 200 in a shooting posture) to reflect an ambient light at different angles.

Thus, the first surface 155, shaped as a vertical line or strip, may function as a sight indicator that shows a center point of the sight in which the user would use in aiming a target. Under the various proposed designs, the first surface 155, as a sight indicator, may cause light reflection using a ramp-like physical feature with a ramp angle ($\alpha$) relative to ground plane 115. Moreover, the second surface 135, with the second angle ($\beta$) as a contrasting angle and surrounding or otherwise on opposite sides of the first surface 155, may cause a shadow to thereby enhance the visibility of the reflection on the sight indicator on the first surface 155. Advantageously, with the proposed designs, the overall production cost of the one-piece sight of device 100 may be lower than a conventional firearm sight since there is no need for an additional step to add marking, engraving or an insert.

Under a proposed design in accordance with the present disclosure with a slope of the first surface 155 being a positive slope and a slope of the second surface 135 being a negative slope, the first surface 155 may generally reflect the ambient light toward the user of firearm 200 when device 100 is in use (e.g., when firearm 200 is held by the user in a shooting posture with the user aiming a target with the aid of device 100). Moreover, the second surface 135 may be generally shadowed (e.g., reflecting the ambient light not toward the user) under the ambient light when device 100 is in use. Under the proposed design, structure 130 may have a contrasting wall 132 (labeled in FIG. 3) on the user-facing side thereof. Moreover, structure 130 may be configured with a ramp 150 protruding from contrasting wall 132. Ramp 150 may be aligned with notch 140 and may be disposed between notch 140 and ground plane 115 on the first primary side of base 110. Accordingly, the first surface 155 may be on ramp 150 and the second surface 135 may be on contrasting wall 132 on two opposite sides (e.g., left side and right side) of ramp 150.

Under the proposed scheme, a ramp angle ($\alpha$) of ramp 150 relative to ground plane 115 may be less than 90° (e.g., in a range of 1°~89°), and the first angle ($\theta$) of the first surface 155 relative to ground plane 115 may be greater than 90° (e.g., in a range of 91°~179°). In other words, the ramp angle ($\alpha$) and the first angle ($\theta$) may be supplementary angles (that is, $\alpha+\theta=180°$). Additionally, the second angle ($\beta$) of the second surface 135 relative to ground plane 115 may be less than 90° (e.g., in a range of 1°~84.9°). For instance, the second angle ($\beta$) may be less than 85°, and a difference between the first angle ($\theta$) and the second angle ($\beta$) may be greater than 5° so as to result in a pronounced contrasting effect with the first surface 155 appearing to be bright (e.g., by reflecting the ambient light generally toward the user) and the second surface 135 appearing to be dark (e.g., by reflecting the ambient light not toward the user).

Under an alternative proposed design in accordance with the present disclosure with a slope of the first surface 155 being a negative slope and a slope of the second surface 135 being a positive slope (not shown), the second surface 135 may generally reflect the ambient light toward the user of firearm 200 when device 100 is in use. Additionally, the first surface 155 may be generally shadowed under the ambient light when device 100 is in use. Under the proposed design, structure 130 may have a contrasting wall 132 on the user-facing side thereof, with second surface 135 being the surface of contrasting wall 132. Structure 130 may be configured with an indentation (not shown) on contrasting wall 132. The indentation may be aligned with notch 140 and may be disposed between notch 140 and ground plane 115 on the first primary side of base 110. Accordingly, the first surface 155 may be on the indentation and the second surface 135 may be on the contrasting wall 132 on two opposite sides (e.g., left side and right side) of the indentation. In the example shown in FIG. 4, contrasting wall 132 (and, hence, second surface 135) may be at an angle (denoted as gamma angle, or $\gamma$, in FIG. 4) with respect to an axis 118 perpendicular to ground plane 115 of the first primary side of base 110. For instance, $\gamma$ may be in a range of 0°~5° and $\beta$ (denoted as beta angle in FIG. 4) may be less than 85° and in a range of 0°~84.9°.

Under this alternative proposed design, the first angle ($\theta$) of the first surface 155 relative to ground plane 115 may be less than 90° (e.g., in a range of 1°~89°). Moreover, the second angle ($\beta$) of the second surface 135 relative to ground plane 115 may be greater than 90° (e.g., in a range of 91°~179°). For instance, the second angle ($\beta$) of the second surface 135 relative to ground plane 115 may be greater than 95°), and a difference between the second angle ($\beta$) and the first angle ($\theta$) may be greater than 5° so as to result in a pronounced contrasting effect with the second surface 135 appearing to be bright (e.g., by reflecting the ambient light generally toward the user) and the first surface 155 appearing to be dark (e.g., by reflecting the ambient light not toward the user).

Figure 5:
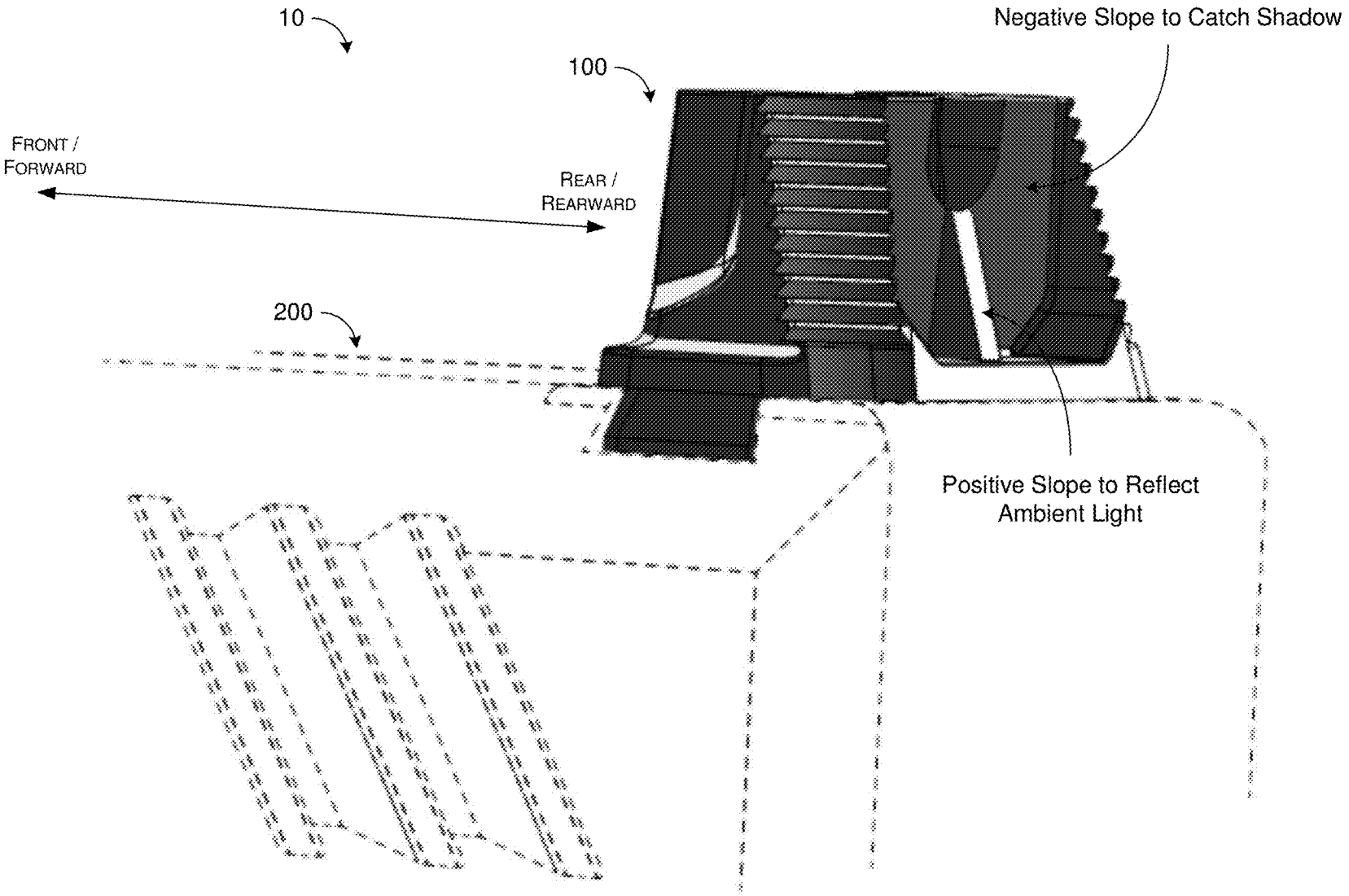
FIG. 5 is a diagram of a perspective close-up view of an apparatus in accordance with an implementation of the present disclosure.
Figure 6:
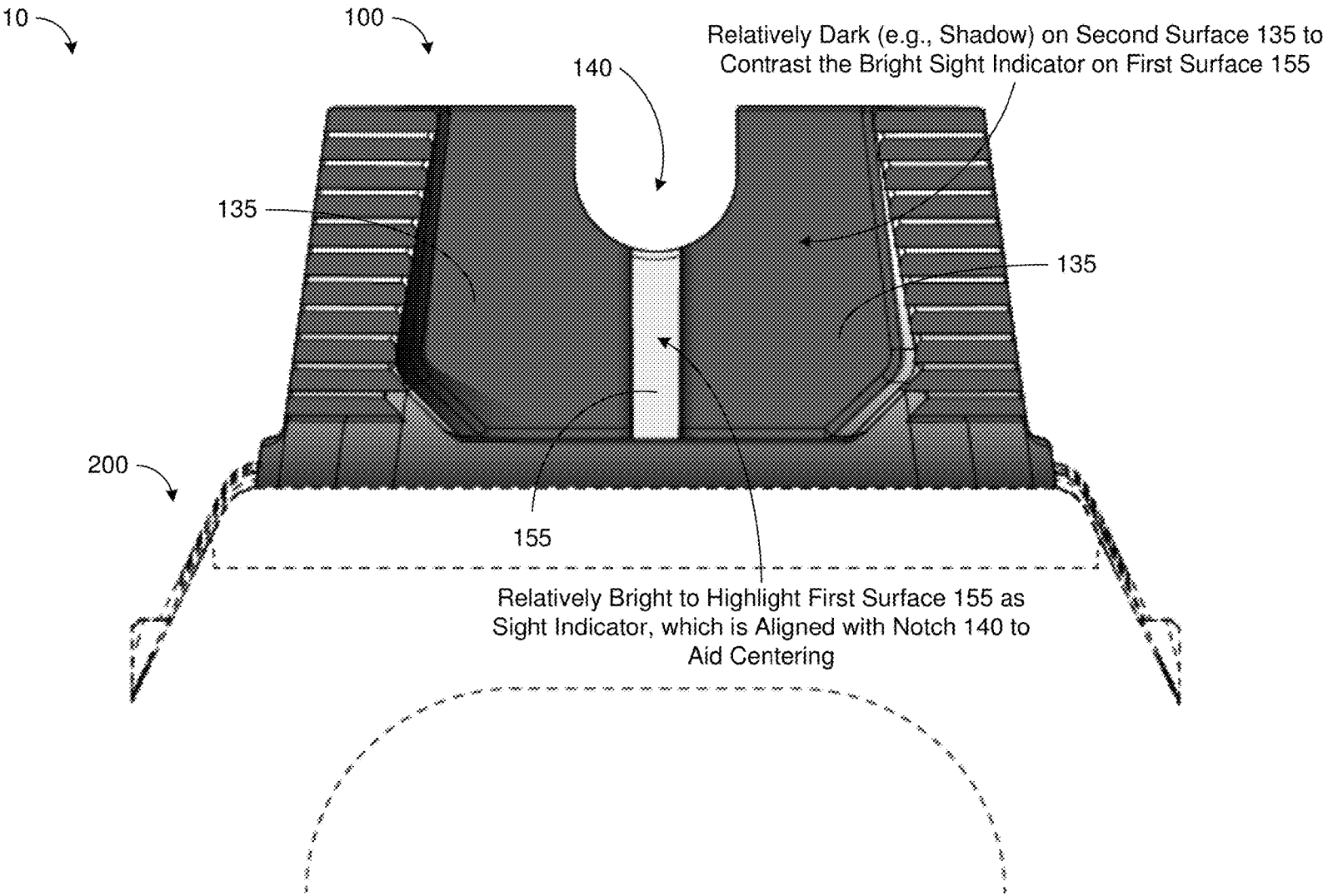
FIG. 6 is a diagram of a rear close-up view of an apparatus in accordance with an implementation of the present disclosure.

FIG. 5 shows a perspective close-up view of an example implementation of apparatus 10. FIG. 6 shows a rear close-up view of an example implementation of apparatus 10. In the example shown in FIG. 5 and FIG. 6, the positive slope of the first surface 155 on ramp 150 causes reflection of the ambient light while the negative slope of the second surface 135 of contrasting wall 132 on both sides of ramp 150 causes a shadow thereon. This design renders the first surface 155 to appear bright and the second surface 135 to appear dark, thereby highlighting the location of the first surface 155 as a sight indicator and hence aids easy and quick target acquisition for the user. It is noteworthy that, in the present disclosure, the term "positive slope" refers to a slope having an angle greater than 90° relative to ground plane 115 when viewed from the rear of device 100 (e.g., facing the user-facing side of structure 130 of device 100), and the term "negative slope" refers to a slope having an angle less than 90° relative to ground plane 115 when viewed from the rear of device 100 (e.g., facing the user-facing side of structure 130 of device 100).

In view of the above, it is believed that device 100 would render target acquisition relatively easier and quicker. This is because the user would be able to center his/her target much more intuitively by aligning the vertical line or strip of the first surface 155 to the target instead of placing the target in the open part of the sight with no center marking or indicator. It is also noteworthy that, with no engraving needed, issues associated with laser engraving such as laser marking (which is not 100% accurate) may be avoided. With laser marking, during production, there might be variation in the location of the sight indicator, and this may result in inaccurate centering in case the engraving is not placed correctly.

It is noteworthy that the dimensions of various components of the proposed design may be adjusted to suit actual implementations. For instance, the overall size may be enlarged for implementation on a firearm of the AR10 platform (e.g., one chambered in 308 Winchester or 7.62×51 mm NATO). Similarly, the overall style may be changed. Likewise, the overall size may be reduced for implementation on a handgun (e.g., semi-automatic pistol or revolver) or a firearm of the AR15 platform (e.g., one chambered in .223 Remington or 5.56×54 mm NATO). It is further noteworthy that each component of device 100 may be made of a suitable material (e.g., a suitable metal such as steel, aluminum, alloy or polymer/plastics) with appropriate mechanical properties such as sufficient strengths and/or hardness to withstand vibrations caused by firing of ammunition cartridges.

In the present disclosure, the term "AR platform" herein refers to firearms based on the AR15 platform and the AR10 platform, as well as any variation and derivative thereof, and include AR15-styled and AR10-styled firearms, including rifles, carbines, pistols and shotguns. A firearm based on an AR platform may be chambered in one of a plethora of calibers. Some of the more popular calibers include such as, for example and without limitation, .223 Remington, 5.56×54 mm NATO, .224 Valkyrie, 300 AAC Blackout, 7.62×39 mm, 458 SOCOM, 6.5 mm Grendel, 6.8 mm Remington SPC, 308 Winchester and 7.62×51 mm NATO, just to name a few. Accordingly, the proposed design in accordance with the present disclosure may be implemented in any firearm based on the AR platform (whether the AR15 platform or the AR10 platform), as well as any variation and derivative thereof, in any suitable caliber.

Example Implementations

In view of the above, the proposed design of a modular forward assist may be implemented in many ways. For illustrative purposes and without limiting the scope of the present disclosure, a few example implementations of the proposed design are described below.

In one aspect, a device (e.g., device 100) implementable on a firearm (e.g., a semi-automatic pistol, a revolver, a rifle, a carbine or a shotgun) may include a one-piece sight functioning as a rear sight or a front sight when installed on the firearm. The one-piece sight may include a base and a structure. The base may have a first primary side and a second primary side opposite the first primary side. The structure may extend from a ground plane on the first primary side of the base with a notch at a center of a distal end of the structure that is away from the base. The structure may have a user-facing side configured with a first surface aligned with the notch and a second surface on two opposite sides of the first surface. The first and second surfaces may be sloped at first and second angles, respectively, with respect to the ground plane to reflect an ambient light at different angles.

In some implementations, the first surface may generally reflect the ambient light toward a user of the firearm when the device is in use. Moreover, the second surface may be generally shadowed under the ambient light when the device is in use.

In some implementations, the structure may have a contrasting wall on the user-facing side thereof. The structure may be configured with a ramp protruding from the contrasting wall. The ramp may be aligned with the notch and may be disposed between the notch and the ground plane on the first primary side of the base.

In some implementations, the first surface may be on the ramp and the second surface may be on the contrasting wall on two opposite sides of the ramp.

In some implementations, a ramp angle ($\alpha$) of the ramp relative to the ground plane may be less than 90°, and the first angle ($\theta$) of the first surface relative to the ground plane may be greater than 90°. In such cases, the ramp angle and the first angle may be supplementary angles (that is, $\alpha+\theta=180°$).

In some implementations, the second angle ($\beta$) of the second surface relative to the ground plane may be less than 90°.

In some implementations, the first angle ($\theta$) of the first surface relative to the ground plane may be greater than 90°, and the second angle ($\beta$) of the second surface relative to the ground plane may be less than 90° (e.g., <85°). In some implementations, a difference between the first angle and the second angle may be greater than 5°.

In some implementations, the second surface may generally reflect the ambient light toward a user of the firearm when the device is in use. Additionally, the first surface may be generally shadowed under the ambient light when the device is in use.

In some implementations, the structure may have a contrasting wall on the user-facing side thereof. The structure may be configured with an indentation on the contrasting wall. The indentation may be aligned with the notch and is disposed between the notch and the ground plane on the first primary side of the base.

In some implementations, the first surface may be on the indentation and the second surface may be on the contrasting wall on two opposite sides of the indentation.

In some implementations, the first angle ($\theta$) of the first surface relative to the ground plane may be less than 90°.

In some implementations, the second angle ($\beta$) of the second surface relative to the ground plane may be greater than 90°.

In some implementations, the first angle ($\theta$) of the first surface relative to the ground plane may be less than 90°, and the second angle ($\beta$) of the second surface relative to the ground plane may be greater than 90° (e.g., >95°). In some implementations, a difference between the second angle and the first angle may be greater than 5°.

In some implementations, the one-piece sight may be a monolithic piece made of metal or polymer.

In some implementations, the one-piece sight may further include a mounting portion extending from the second primary side of the base and configured to mate with a dovetail rail or a groove on the firearm to result in the mounting portion being received in the dovetail rail or the groove when the one-piece sight is installed on the firearm.

In another aspect, a device (e.g., device 100) implementable on a firearm (e.g., a semi-automatic pistol, a revolver, a rifle, a carbine or a shotgun) may include a one-piece sight functioning as a rear sight or a front sight when installed on the firearm. The one-piece sight may include a notch and a user-facing side configured with a first surface aligned with the notch and a second surface on two opposite sides of the first surface. The first and second surfaces may be sloped at first and second angles, respectively, to reflect an ambient light at different angles.

In some implementations, the first surface may generally reflect the ambient light toward a user of the firearm when the device is in use. Moreover, the second surface may be generally shadowed under the ambient light when the device is in use.

In some implementations, the first angle ($\theta$) of the first surface relative to a ground plane on the one-piece sight may be greater than 90°.

In some implementations, the second angle ($\beta$) of the second surface relative to a ground plane on the one-piece sight may be less than 90°.

In some implementations, the first angle ($\theta$) of the first surface relative to a ground plane on the one-piece sight may be greater than 90°, and the second angle ($\beta$) of the second surface relative to the ground plane may be less than 90° (e.g., <85°). In some implementations, a difference between the first angle and the second angle may be greater than 5°.

In some implementations, the one-piece sight may be a monolithic piece made of metal or polymer.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a one-piece sight functioning as a rear sight or a front sight when installed on the firearm, the one-piece sight comprising:

a base having a first primary side and a second primary side opposite the first primary side; and a structure extending from a ground plane on the first primary side of the base with a notch at a center of a distal end of the structure that is away from the base, wherein the structure has a user-facing side configured with a first surface aligned with the notch and a second surface on two opposite sides of the first surface, and wherein the first and second surfaces are sloped at first and second angles, respectively, with respect to the ground plane to reflect an ambient light at different angles.

2. The device of claim 1, wherein the first surface generally reflects the ambient light toward a user of the firearm when the device is in use, and wherein the second surface is generally shadowed under the ambient light when the device is in use.

3. The device of claim 1, wherein the structure has a contrasting wall on the user-facing side thereof, wherein the structure is configured with a ramp protruding from the contrasting wall, and wherein the ramp is aligned with the notch and is disposed between the notch and the ground plane on the first primary side of the base.

4. The device of claim 3, wherein the first surface is on the ramp and the second surface is on the contrasting wall on two opposite sides of the ramp.

5. The device of claim 4, wherein the first angle (θ) of the first surface relative to the ground plane is greater than 90°.

6. The device of claim 4, wherein the second angle (β) of the second surface relative to the ground plane is less than 90°.

7. The device of claim 4, wherein the first angle (θ) of the first surface relative to the ground plane is greater than 90°, wherein the second angle (β) of the second surface relative to the ground plane is less than 90°, and wherein a difference between the first angle and the second angle is greater than 5°.

8. The device of claim 1, wherein the second surface generally reflects the ambient light toward a user of the firearm when the device is in use, and wherein the first surface is generally shadowed under the ambient light when the device is in use.

9. The device of claim 1, wherein the structure has a contrasting wall on the user-facing side thereof, wherein the structure is configured with an indentation on the contrasting wall, and wherein the indentation is aligned with the notch and is disposed between the notch and the ground plane on the first primary side of the base.

10. The device of claim 9, wherein the first surface is on the indentation and the second surface is on the contrasting wall on two opposite sides of the indentation.

11. The device of claim 10, wherein the first angle (θ) of the first surface relative to the ground plane is less than 90°.

12. The device of claim 10, wherein the second angle (β) of the second surface relative to the ground plane is greater than 90°.

13. The device of claim 10, wherein the first angle (θ) of the first surface relative to the ground plane is less than 90°, wherein the second angle (β) of the second surface relative to the ground plane is greater than 90°, and wherein a difference between the second angle and the first angle is greater than 5°.

14. The device of claim 1, wherein the one-piece sight is a monolithic piece made of metal or polymer.

15. The device of claim 1, wherein the one-piece sight further comprises:

a mounting portion extending from the second primary side of the base and configured to mate with a dovetail rail or a groove on the firearm to result in the mounting portion being received in the dovetail rail or the groove when the one-piece sight is installed on the firearm.

16. A device implementable on a firearm, comprising:

a one-piece sight functioning as a rear sight or a front sight when installed on the firearm, the one-piece sight comprising a notch and a user-facing side configured with a first surface aligned with the notch and a second surface on two opposite sides of the first surface, wherein the first and second surfaces are sloped at first and second angles, respectively, to reflect an ambient light at different angles.

17. The device of claim 16, wherein the first surface generally reflects the ambient light toward a user of the firearm when the device is in use, and wherein the second surface is generally shadowed under the ambient light when the device is in use.

18. The device of claim 16, wherein the first angle (θ) of the first surface relative to a ground plane on the one-piece sight is greater than 90°.

19. The device of claim 16, wherein the second angle (β) of the second surface relative to a ground plane on the one-piece sight is less than 90°.

20. The device of claim 16, wherein the first angle (θ) of the first surface relative to a ground plane on the one-piece sight is greater than 90°, and wherein the second angle (β) of the second surface relative to the ground plane is less than 90°, and wherein a difference between the first angle and the second angle is greater than 5°.

* * * * *